US006772569B2

(12) United States Patent
Bennett et al.

(10) Patent No.: US 6,772,569 B2
(45) Date of Patent: Aug. 10, 2004

(54) TONGUE AND GROOVE PANEL

(76) Inventors: John Landus Bennett, 176 Rolling Hills La., Clarkesville, GA (US) 30523; Thomas Leo Schuman, 828 Hwy. 124 West, Jefferson, GA (US) 30549

( * ) Notice: Subject to any disclaimer, the term of this patent is extended or adjusted under 35 U.S.C. 154(b) by 45 days.

(21) Appl. No.: 10/072,444

(22) Filed: Feb. 6, 2002

(65) Prior Publication Data

US 2003/0145550 A1 Aug. 7, 2003

(51) Int. Cl.[7] ..... E04B 2/08

(52) U.S. Cl. ..... 52/592.1; 52/592.1; 52/539; 52/90.1

(58) Field of Search ..... 52/592.1, 592.4, 52/539, 553, 515, 796.1, 233, 591.1, 519, 90.1

(56) References Cited

U.S. PATENT DOCUMENTS

| | | | | | |
|---|---|---|---|---|---|
| 1,551,544 | A | * | 9/1925 | Crooks | 52/591.1 |
| 1,920,931 | A | * | 8/1933 | Finley | 52/515 |
| 3,885,075 | A | * | 5/1975 | Ferrante | 428/150 |
| 4,471,012 | A | * | 9/1984 | Maxwell | 428/106 |
| 4,651,494 | A | | 3/1987 | Van Wagoner | |
| 4,852,314 | A | | 8/1989 | Moore, Jr. | |
| 5,165,816 | A | * | 11/1992 | Parasin | 403/334 |
| 5,335,473 | A | | 8/1994 | Chase | |

FOREIGN PATENT DOCUMENTS

| | | | |
|---|---|---|---|
| EP | 304995 | * | 1/1989 |

* cited by examiner

*Primary Examiner*—Carl D. Friedman
*Assistant Examiner*—Naoko Slack
(74) *Attorney, Agent, or Firm*—Carlos Nieves; Mitchell Goodrich

(57) ABSTRACT

A composite wood panel is disclosed, the wood panel having parallel first and second longitudinal edges, and parallel upper and lower faces, and comprising: a groove formed along the second longitudinal edge, a complementary shaped tongue formed along the first longitudinal edge, and a barrier layer. A first surface extends from the tongue to the upper surface and forms a generally obtuse angle, α, with the upper surface, while a matching surface extends from the groove forming a generally acute angle, β, with the upper surface, and the sum of α and β is from about 175° to less than about 180°. The composite wood panel allows for convenient and fast assembly, particularly in constructing roofs, and also provides resistance against the penetration of water through the structure formed by the panels.

18 Claims, 2 Drawing Sheets

TONGUE AND GROOVE PANEL

BACKGROUND OF THE INVENTION

The roof of a residential or commercial building is typically constructed by attaching several roofing panels to the rafters of an underlying supporting structural frame; the panels are placed in a quilt-like pattern with the edge of each panel contacting the edges of adjacent panels. Constructing a roof in this manner has the advantage of requiring the efforts of only a few workers, and may considerably reduce the time required for constructing a roof.

However, problems with roofs constructed according to this method may present themselves. In particular, small gaps along the edges of adjoining roofing panels remain after roof assembly, which over time become smaller as the panels expand. But to prevent water from leaking through these gaps, it is common to put a barrier layer on top of the roofing panels (e.g., felt paper). Accordingly, there is a need in the art for roofing panels, which can be conveniently fit together and yet are constructed to minimize the gaps between adjacent roofing panels to prevent the penetration of water through the roof as it travels over the roof's surface.

Furthermore, the water-impermeability of roofing panels may be improved by adding a layer of impermeable material, such as asphalt-impregnated roofing paper or felt over the external surface of the roof panels. However, while this provides additional protection against water penetration, it has the disadvantage of being difficult and time-consuming to install because the paper or felt must be first unrolled and spread over the roof surface and then secured to those panels. If this roofing paper were attached to the roofing panels during manufacture then the additional step of attaching the roofing paper to the panels after the installation of the panels could be avoided along with the occasional need to reinstall or reattach the roofing paper when it is damaged during roof construction by inclement weather.

Given the foregoing, there is a continuing need to develop panels for roof construction that prevent the penetration of water by having an improved tongue and groove edge finish, and additionally come pre-equipped with a water-impermeable barrier layer applied during manufacture.

BRIEF SUMMARY OF THE INVENTION

The invention provides a composite wood panel having parallel first and second longitudinal edges, and parallel upper and lower faces, and comprising: a groove formed along the second longitudinal edge, a complementary shaped tongue formed along the first longitudinal edge, and a barrier layer. A first surface extends from the tongue to the upper surface and forms a generally obtuse angle, $\alpha$, with the upper surface, while a matching surface extends from the groove forming a generally acute angle, $\beta$, with the upper surface, and the sum of $\alpha$ and $\beta$ is from about 175° to less than about 180°.

The invention also provides a roof construction for a building comprising a frame structure; and a plurality of composite wood panels attached to the frame structure. Each panel has parallel first and second longitudinal edges, and parallel upper and lower faces, and comprises a groove formed along the second longitudinal edge, a complementary shaped tongue formed along the first longitudinal edge, a barrier layer. A first surface extends from the tongue to the upper surface and forms a generally obtuse angle, $\alpha$, with the upper surface, a matching surface extends from the groove forming a generally acute angle, $\beta$, with the upper surface, and the sum of $\alpha$ and $\beta$ is from about 175° to less than about 180°. The first angled surface, the second angled surface, and the top surface of the tongue define an upper space that forms an acute angle, $\theta$, with the upper surface of the panel.

The invention also provides a composite wood panel having parallel first and second longitudinal edges, and parallel upper and lower faces, and comprising: a groove formed along the second longitudinal edge, a complementary shaped tongue formed along the first longitudinal edge. A first surface extends from the tongue to the upper surface and forms a generally obtuse angle, $\alpha$, with the upper surface, a matching surface extends from the groove forming a generally acute angle, $\beta$, with the upper surface, and the sum of $\alpha$ and $\beta$ is from about 175° to less than about 180°. The first longitudinal edge and the second longitudinal edge abut below the tongue to create a tight joint fit.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown in the drawings, and that for purposes of illustration, these figures are not necessarily drawn to scale.

DETAILED DESCRIPTION OF THE INVENTION

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibers bonded together by lignin polymer.

By "wood composite material" it is meant a composite material that comprises wood and one or more other additives, such as adhesives or waxes. Non-limiting examples of wood composite materials include oriented strand board ("OSB"), waferboard, particle board, chipboard, medium-density fiberboard, plywood, and boards that are a composite of strands and ply veneers. As used herein, "flakes", "strands", and "wafers" are considered equivalent to one another and are used interchangeably. A non-exclusive description of wood composite materials may be found in the Supplement Volume to the Kirk-Rothmer Encyclopedia of Chemical Technology, pp 765-810, $6^{th}$ Edition.

The following describes preferred embodiments of the present invention which provides a panel, attached to the rafters of a timber frame structure to form a roof, and is suitable for use in the construction of residential and commercial buildings. A tongue and groove finish on the longitudinal edges of each panel allows adjacent panels to be easily connected to each other by tongue and groove joints, while at the same time resisting the penetration of water into the joint and through the panels. Additionally, the panels prepared according to the present invention may have a layer of roofing paper attached to it during manufacture. Because the barrier layer is attached to the roofing panels during manufacture, the additional step of applying the barrier layer over the panels during construction of the roof is avoided.

Figure 1:
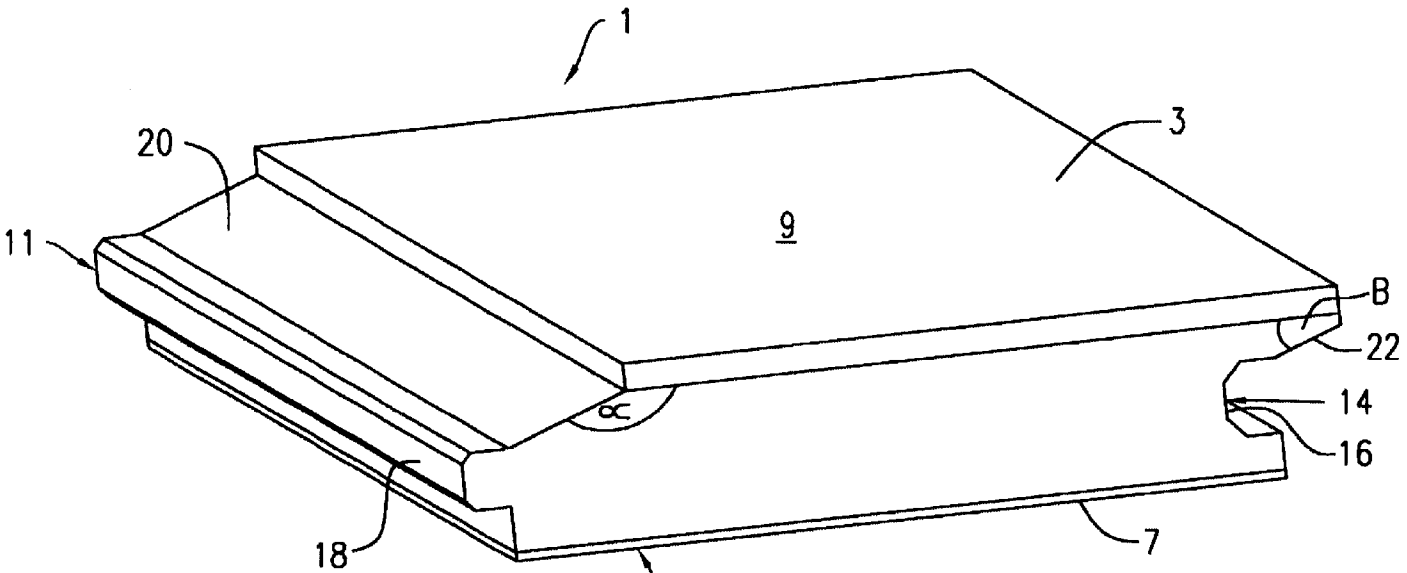
FIG. 1 is a perspective view of a panel prepared according to the present invention.
Figure 2:
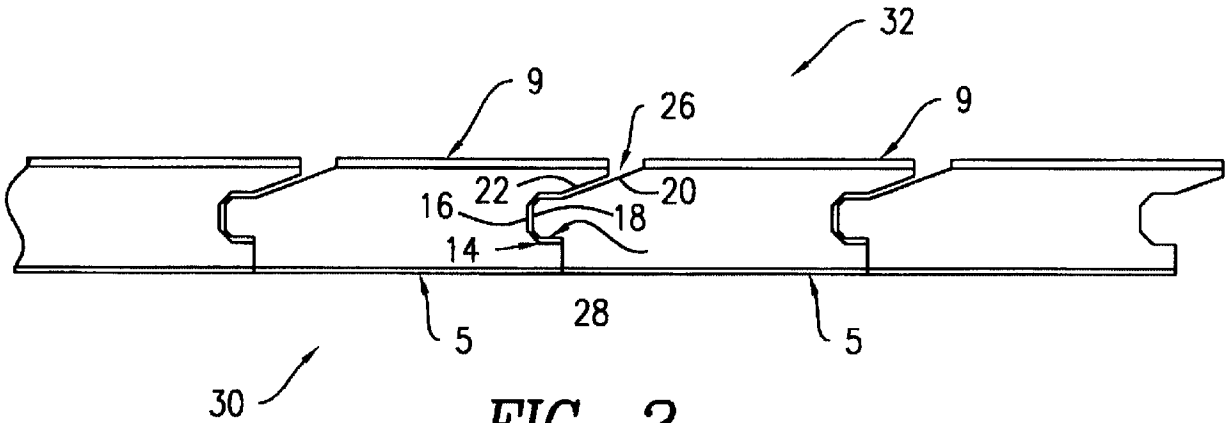
FIG. 2 is a front view of a first panel and a second panel, both prepared according to the present invention, and attached along their second longitudinal edge and first longitudinal edge respectively.
Figure 3:
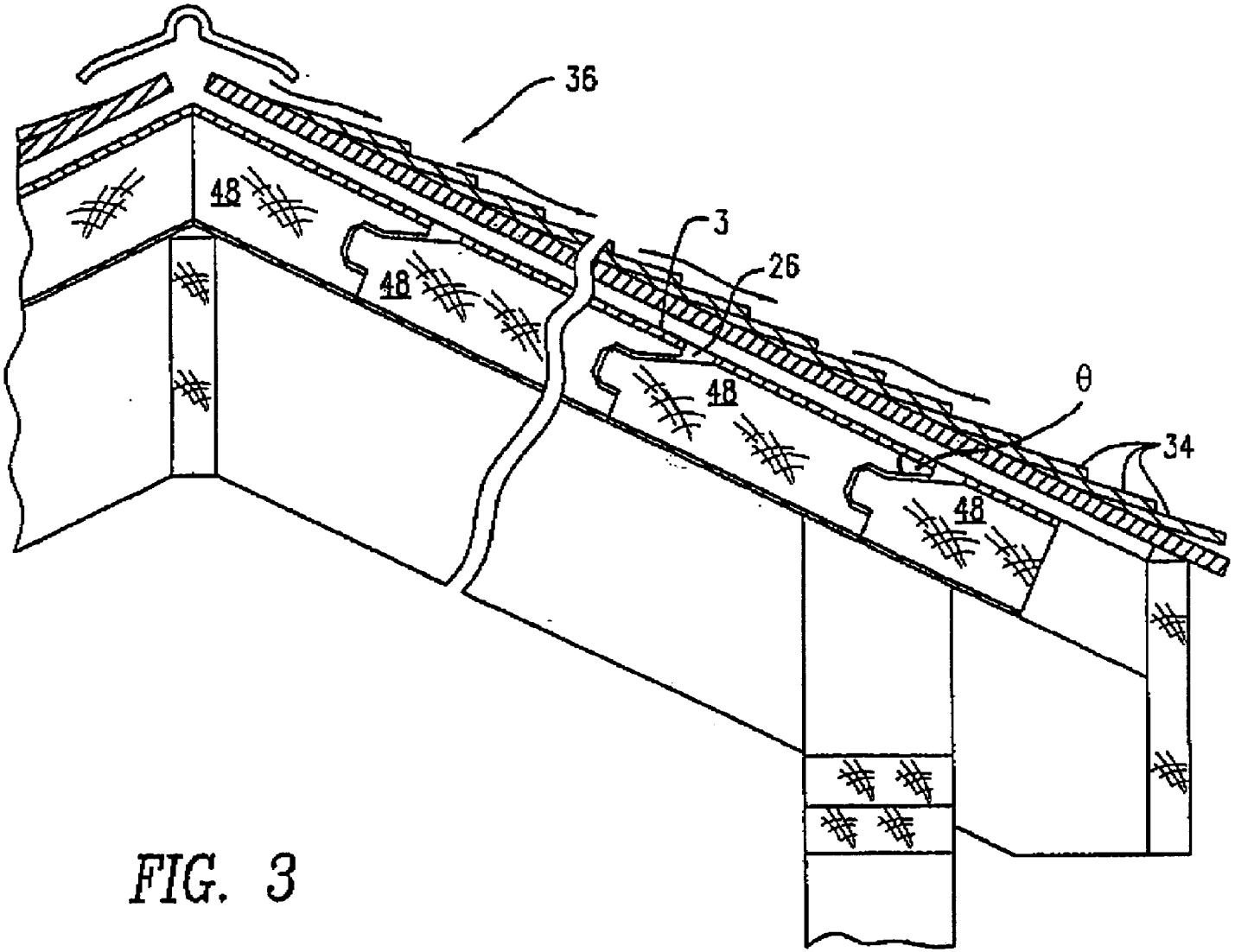
FIG. 3 is a cross-sectional view of a roof, the roof being constructed with panels prepared according to the present invention.

As shown in FIG. 1, there is a composite wood panel 1 having parallel first and second longitudinal edges 11, 14, and parallel upper and lower faces 3, 5, and comprising: a groove 16 formed along the second longitudinal edge 14, a complementary shaped tongue 18 formed along the first longitudinal edge 11, and barrier layer 9. As can be seen in FIG. 1, the groove and the complementary shaped tongue continue uninterrupted along the length of the second longitudinal edge 14 and first longitudinal edge 11, respectively. A first angled surface 20 extends from the tongue 18 to the upper surface 3 and forms a generally obtuse angle, $\alpha$, with the upper surface 3. A second angled surface 22 extends from the groove 16 forming a generally acute angle, $\beta$, with the upper surface 3. In FIGS. 1–3, the sum of $\alpha$ and $\beta$ is about 180°, but in practice the sum of $\alpha$ and $\beta$ may be from about 175° to less than about 180°, such as from about 175° to about 179°. As an optional element of the present invention, the panel 1 may have a radiant barrier material 7 secured to the lower face 5 as illustrated in FIGS. 1–3.

Several panels are shown in FIG. 2, with particularly a first panel 30 and an adjacent second panel 32 interconnected along the matching first longitudinal edge 11 of the second panel 32 and second longitudinal edge 14 of the first panel 30 to form a tongue and groove joint. The tongue and the groove are provided to attach adjacent panels together, provide a barrier to the penetration of water through the thickness of the panel, and cooperate as load bearing surfaces to transfer the load from one panel to another thereby preventing adjacent panels from excessive movement or deflection relative to each other. Along the length of the joint is an upper space 26 and a lower space 28 that are separated by the tongue 18.

The lower space 28 is defined by the first and second longitudinal edges 11, 14 and the bottom of the tongue 18; the upper space 26 is defined by the first angled surface 20 and the second angled surface 22 and the top of the tongue 18. As shown in FIG. 2, the width of the tongue 18 on the second panel 32 is less than the width of the groove 16 on the first panel 30, and the length of the tongue 18 is less than the length of the groove 16, so that the first longitudinal edge 11 and the second longitudinal edge 14 contact below the tongue 18 to create a tight adjoining fit. However, panels according to the present invention may be constructed so that the lower space 28 is wider than the narrow crack shown in FIG. 2. As seen in FIG. 2, an upper space 26 is defined by the first angled surface 20 and the second angled surface 22 and the top surface of the tongue 18. Glue (not shown) may be applied to the tongue and groove during assembly of these joints. In reality there is not as much of a gap over the upper space 26 between adjoining panels as is shown in FIG. 2.

FIG. 3 shows a cross-sectional view of a finished roof 36 made up of several interconnected panels 48, with a barrier layer 9 attached to each, and roofing shingles 34 put in place (for additional protection against water penetration as well as to improve the appearance of the roof) over the barrier layer 9 and panels 48. As shown in FIG. 3, the panels are attached along the roof so that the upper space 26 forms an acute angle, $\theta$, with the upper face 3 of each panel 48. Because of the orientation of the upper space 26 with the upper face 3 of the panel 48 and the simultaneously formed orientation of the upper space 26 with the roof 36 and roofing shingles 34, then water (illustrated by arrows) flowing down the roof 36 will tend to flow over the upper space 26 and further down the roof 36.

Thus, when a roof is prepared from panels constructed as discussed above, there is an extra barrier against water penetration in addition to the barrier layer 9. This additional level of protection may be particularly useful when the paper has been damaged either during installation or in service. And in fact, although it is a less preferred embodiment of the present invention, panels may be prepared without the use of the barrier layer 9. In this case, the acute angle, $\theta$, is measured with respect to the upper face 3 of the panel. In this embodiment, to resist the penetration of water, the panels rely on a combination of the aforementioned orientation of the upper space 26 with the roof 36 that encourages water to pass over the openings to the upper space 26, as well as a tight, abutting fit below the tongue 18 between interconnecting panels as shown in FIG. 2.

The barrier layer 9 may be selected from a suitable material that provides adequate protection against the permeation of water, such as asphalt-felt paper. Some materials (particularly certain coatings) may also provide skid resistance and additional protection against ultraviolet light.

Asphalt-felt or "tar-paper" is made from fibers or strands ("felt") saturated with a sizing compound. The fibers or felt are typically made from cellulosic fibers, which may be obtained from wood, paper or waste products such as rags and waste paper. Other types of fibers, such as glass fibers, may be mixed in with the cellulosic fibers. The sizing compound is applied to the strands or fibers to improve one or more of the following material characteristics: abrasion-resistance, strength, stiffness, processability, durability and handling attributes. The sizing compound may be asphalt, such as asphalt obtained from fossil remnant products like petroleum and coal, such as petroleum distillates. The cellulosic fibers are impregnated and coated with the sizing, so that the level of saturation is from about 60 wt % to about 150 wt %. A preferred paper material for use in the barrier layer has a nominal weight of 15 lbs/100 $ft^2$ to 30 lbs/100 $ft^2$, and an actual weight of 7 lbs/100 $ft^2$ to 28 lbs/100 $ft^2$. Particularly preferred are asphalt-impregnated papers within this range.

The barrier layer may also include other additives, such as pigments and binders. Suitable binders include acrylamides, starches, urea resins, phenol resins, sodium silicates, epoxy resins, as well as other polymers.

Suitable asphalt-felt type paper underlayment is discussed in greater detail in U.S. Pat. No. 4,472,243, issued Sep. 18, 1984 to Bondoc et al., and U.S. Pat. No. 4,035,544, issued Jul. 12, 1977, to Iwasaki et al. The use of non-asphaltic sizing material and non-cellulosic fibers are discussed in U.S. Pat. No. 5,776,841, issued Jul. 7, 1998, to Bondoc et al.

Also suitable as inclusion in the barrier layer are high and medium-density overlay materials. High-density overlay materials are typically resin-impregnated crepe paper, while medium-density overlay materials are resin-impregnated kraft paper. These overlays are made by saturating a kraft or crepe paper with a thermosetting resin (such as phenolic resin) and then curing the resin. Suitable high and medium-density overlays are disclosed in U.S. Pat. No. 5,116,446, issued May 26, 1992, to Cannon, and U.S. Pat. No. 5,089,348, issued Feb. 18, 1992, to Louderback.

The barrier layer 9 may also include a coating applied as a liquid. This coating may be composed of tar, asphalt, and acrylic or latex paint. The coating may be used in place of or in combination with the papers described above and may enhance one or more of the following properties of the presently described panels: water resistance, skid resistance, and UV resistance.

The presently described panels may also comprise a radiant barrier material attached to the lower face 5 of the panel, i.e., the face of the panel facing inwardly, toward the interior of the building. The radiant barrier material has a reflective surface that reflects infrared radiation that penetrates through the roof back into the atmosphere. The combination of this reflective function, as well as the foil's low emissivity, limits the heat transfer to the attic space formed in the interior of the building in the space under the roof. By limiting the heat transfer, the attic space temperature is reduced, which in turn reduces the cost of cooling the house.

The radiant barrier material may simply be a single layer radiant barrier sheet, such as metal foil, such as aluminum foil. Alternatively, the radiant barrier material may be composed of a radiant barrier sheet adhered to a reinforcing backing layer made from a suitable backing material, such as polymeric film, corrugated paper board, fiber board or kraft paper. The backing material makes the foil material easier and more convenient to handle. The multi-layered material may be a laminate in which a backing material is laminated to a radiant barrier sheet.

Methods of manufacturing the radiant barrier material are discussed in greater detail in U.S. Pat. No. 5,231,814, issued Aug. 3, 1993 to Hageman and U.S. Pat. No. 3,041,219, issued Jun. 26, 1962, to Steck et al. Other suitable radiant barrier material is manufactured under the name SUPER R™ by Innovative Insulation, Inc. of Arlington, Tex. These SUPER R™ products have two layers of aluminum foil each of which have an aluminum purity of 99%, and a reinforcing member located inside, between the two layers. The reinforcing member may be a reinforcing scrim or a polymer fabric.

Both the radiant barrier material and the barrier layer can be applied to the panel by spreading a coat of adhesive to the surface of the panel, applying the heat-reflecting material (or the barrier layer) over the adhesive onto the panel and pressing the radiant barrier material (or barrier layer) onto the panel. After the adhesive dries or cures, the panel is ready for use.

The panels prepared according to the present invention may be made from a variety of different materials, such as wood or wood composite materials, such as oriented strand board ("OSB"). OSB panels are derived from a starting material that is naturally occurring hard or soft woods, singularly or mixed, whether such wood is dry (having a moisture content of between 2 wt % and 12 wt %) or green (having a moisture content of between 30 wt % and 200 wt %). Typically, the raw wood starting materials, either virgin or reclaimed, are cut into strands, wafers or flakes of desired size and shape, which are well known to one of ordinary skill in the art.

After the strands are cut they are dried in an oven to a moisture content of about 2 wt % to 5 wt % and then coated with one or more polymeric thermosetting binder resins, waxes and other additives. The binder resin and the other various additives that are applied to the wood materials are referred to herein as a coating, even though the binder and additives may be in the form of small particles, such as atomized particles or solid particles, which do not form a continuous coating upon the wood material. Conventionally, the binder, wax and any other additives are applied to the wood materials by one or more spraying, blending or mixing techniques, a preferred technique is to spray the wax, resin and other additives upon the wood strands as the strands are tumbled in a drum blender.

After being coated and treated with the desired coating and treatment chemicals, these coated strands are used to form a multi-layered mat. In a conventional process for forming a multi-layered mat, the coated wood materials are spread on a conveyor belt with two surface exterior layers and one or more interior "core" layers. Preferably the multi-layered mat is formed from three layers. The strands are positioned on the conveyor belt as alternating layers where the "strands" in adjacent layers are oriented generally perpendicular to each other.

Various polymeric resins, preferably thermosetting resins, may be employed as binders for the wood flakes or strands. Suitable polymeric binders include isocyanate resin, urea-formaldehyde, phenol formaldehyde, melamine formaldehyde ("MUF") and the copolymers thereof. Isocyanates are the preferred binders, and preferably the isocyanates are selected from the diphenylmethane-p,p'-diisocyanate group of polymers, which have NCO-functional groups that can react with other organic groups to form polymer groups such as polyurea, —NCON—, and polyurethane, —NCOON—. 4,4-diphenyl-methane diisocyanate ("MDI") is preferred. A suitable commercial MDI product is Rubinate pMDI available from ICI Chemicals Polyurethane Group. Suitable commercial MUF binders are the LS 2358 and LS 2250 products from the Dynea corporation.

The binder concentration is preferably in the range of about 1.5 wt % to about 20 wt %, more preferably about 3 wt % to about 10 wt %. A wax additive is commonly employed to enhance the resistance of the OSB panels to moisture penetration. Preferred waxes are slack wax or an emulsion wax. The wax loading level is preferably in the range of about 0.5 to about 2.5 wt %.

After the multi-layered mats are formed according to the process discussed above, they are compressed under a hot press machine that fuses and binds together the wood materials, binder, and other additives to form consolidated OSB panels of various thickness and sizes. The high temperature also acts to cure the binder material. Preferably, the panels of the invention are pressed for 2–10 minutes at a temperature of about 175° C. to about 240° C. The resulting composite panels will have a density in the range of about 35 to about 50 pcf (as measured by ASTM standard D1037-98) and a thickness of about 0.6 cm (about ¼") to about 3.8 cm (about 1½").

After leaving the hot press machine, the panel may be cut to an appropriate size to facilitate subsequent processing on the finishing line. This subsequent processing includes the steps of trimming the panel to the desired width, sanding the panel, applying water-repellant coatings, and applying indicia (such as lettering, inked stamps, paint or product packaging) to the panel to specify the panels' manufacture, origin, quality grade and other pertinent information.

Another important post-hot pressing step is cutting a tongue and groove profile on the longitudinal edges of the panels. A variety of different apparatuses known to those of ordinary skill in the art may be used to form this profile, but the process for cutting the tongue and groove remains the same regardless of the particular equipment used. A "double end tenoner" is one commonly-used apparatus for cutting a tongue and groove profile on a wood panels. The double end tenoner may have several cutter heads and/or saw blades installed to perform multiple functions in a single pass. Typically a double end tenoner will have scoring blades, hogging saws, then a series of high-speed cutter heads.

In operation, the panel is moved through the double end tenoner by the feed rolls in a hold-down device or a precision feed chain. The precision feed chain consists of interconnected links, each of which carries a rubber pad, the chains running through machined channels (or "ways") Alternatively, in the hold down device, the panel enters the hold-down device, it makes contact with four steel drive rollers (coated with rubber or some other elastomer) which reduces slippage to ensure that the panel is firmly held throughout the cutting process.

Typically, the panel is first trimmed to size by the scoring blade and the hogging saw. Then with high-speed cutter heads, tongue and groove profiles are cut on the longitudinal edges. These cutter heads have knives, shaped to the T&G profile, mounted on them in a way so that as the panel passes by the cutter heads a tongue will be milled on one edge of the panel and a groove is milled on the other edge so that the tongue of one panel fits into the groove of an adjacent panel.

After manufacture, the panels are attached to a conventional frame structure to form the roof. This frame structure has a plurality of rafters, which may be spaced any distance apart from each other. These vertical components are connected at each end by horizontal frame components.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A composite wood panel having parallel first and second longitudinal edges, and parallel upper and lower faces, and comprising: a barrier layer made from fibers impregnated with a sizing compound, a groove formed along the second longitudinal edge, and a complementary shaped tongue formed along the first longitudinal edge; wherein a first surface extends from the tongue to the upper surface and forms a generally obtuse angle, $\alpha$, with the upper surface, a matching surface extends from the groove forming a generally acute angle, $\beta$, with the upper surface, and the sum of $\alpha$ and $\beta$ is from about 175° to about 185°.

2. The composite wood panel according to claim 1, wherein the fibers are cellulosic fibers.

3. The composite wood panel according to claim 1, wherein the sizing compound is selected from the group consisting of asphalt and non-asphaltic sizing.

4. The composite wood panel according to claim 1, wherein the barrier layer is selected from the group consisting of asphalt-impregnated felt and high density overlay.

5. The composite wood panel according to claim 1, wherein the panel further comprises a radiant barrier material.

6. The composite wood panel according to claim 5, wherein the radiant barrier material comprises a first layer of metal foil, and a backing layer.

7. The composite wood panel according to claim 5, wherein the radiant barrier material is attached to the parallel upper and lower faces.

8. The composite wood panel according to the claim 1, wherein the tongue has beveled edges.

9. The composite wood panel according to claim 1, wherein a first abutment is formed along the first longitudinal edge and extends from the tongue to the lower face and a second abutment is formed along the second longitudinal edge and extends from the groove to the lower face.

10. The composite wood panel according to claim 9, wherein the of the tongue is than the length of the groove so that the first abutment contacts the second abutment to form a tight fit.

11. The composite wood panel according to claim 1, wherein the width of the tongue is less than the width of the groove.

12. The composite wood panel according to claim 1, wherein the fibers are selected from the group consisting of cellulosic fibers, fiberglass fibers, polymer fibers, and glass fibers.

13. The composite wood panel according to claim 1, wherein the tongue continues uninterrupted along the length of the first longitudinal edge.

14. The composite wood panel according to claim 1, wherein the composite wood panel is composed of oriented strand board.

15. The composite wood panel according to claim 1, wherein the sum of $\alpha$ and $\beta$ is about 180°.

16. A composite wood panel having parallel first and second longitudinal edges, and parallel upper and lower faces, and comprising: a groove formed along the second longitudinal edge, a complementary shaped tongue formed along the first longitudinal edge, and; wherein a first surface extends from the tongue to the upper surface and forms a generally obtuse angle, $\alpha$, with the upper surface, a matching surface extends from the groove forming a generally acute angle, $\beta$, with the upper surface, and the sum of $\alpha$ and $\beta$ is from about 175° to less than about 180°; and the first longitudinal edge and the second longitudinal edge abut below the tongue to create a tight joint fit.

17. A roof construction for a building comprising:

a frame structure; and a plurality of composite wood panels attached to the frame structure, each panel having parallel first and second longitudinal edges, and parallel upper and lower faces, and comprising; a groove formed along the second longitudinal edge, a complementary shaped tongue formed along the first longitudinal edge, each cancel further comprising a barrier layer made from cellulosic fibers impregnated with a sizing compound and a first surface extends from the tongue to the upper surface and forms a generally obtuse angle, $\alpha$, with the upper surface, a matching surface extends from the groove forming a generally acute angle, $\beta$, with the upper surface, and the sum of $\alpha$ and $\beta$ is from about 175° to less than about 180°; wherein the first angled surface, the second angled surface, and the top surface of the tongue define an upper space that forms an acute angle, $\theta$, with the upper face of each panel.

18. A roof construction according to claim 17, wherein each panel further comprises a barrier layer.

* * * * *